US006182593B1

(12) United States Patent
Wierick

(10) Patent No.: US 6,182,593 B1
(45) Date of Patent: Feb. 6, 2001

(54) SEA GOING BARGE TRAIN

(76) Inventor: Carlos Kountz Wierick, 4 Gema, Colonia Central, Zihuatanejo, Guerrero, 40880 (MX)

( * ) Notice: Under 35 U.S.C. 154(b), the term of this patent shall be extended for 0 days.

(21) Appl. No.: 09/234,247

(22) Filed: Jan. 20, 1999

(51) Int. Cl.[7] ..... B63B 21/58
(52) U.S. Cl. ..... 114/249; 114/242
(58) Field of Search ..... 114/242, 244, 114/246, 247, 249, 250, 26

(56) References Cited

U.S. PATENT DOCUMENTS

| | | | | |
|---|---|---|---|---|
| 2,431,039 | | 11/1947 | Harrison | 114/235 |
| 2,727,485 | * | 12/1955 | Combs | 114/242 |
| 3,478,711 | * | 11/1969 | Combs | 114/242 |
| 3,809,002 | * | 5/1974 | Nagy et al. | 114/242 |
| 3,830,186 | * | 8/1974 | Janssen et al. | 114/242 |
| 3,938,461 | * | 2/1976 | Marriner | 114/248 |
| 4,080,921 | | 3/1978 | Freitag | 114/249 |
| 4,335,670 | | 6/1982 | Skaalen et al. | 114/249 |

FOREIGN PATENT DOCUMENTS

| | | | |
|---|---|---|---|
| 475984 | 8/1976 | (AU) | 114/249 |

* cited by examiner

*Primary Examiner*—Ed Swinehart
(74) *Attorney, Agent, or Firm*—Bucknam and Archer

(57) ABSTRACT

There is provided a sea going barge train or modular tanker vessel for ocean transportation of cargo, such as oil or other dry or liquid materials, consisting of a forward traction unit, a rear powered caboose unit and a series of modular units or barges interposed therebetween wherein the units are serially and flexibly interconnected by means of a universal type coupling which permits relative limited yaw, pitch and roll movement between units. The hull of each barge unit is substantially semi-cylindrically shaped so that the hull immersed section is circular and the barge units are detachably coupled to each other fore and aft and to the traction and caboose units at the circle center of the circle segment defined by the hull cross section so that hull continuity of the barge train is maintained as the barge units roll relative to each other. The universal type coupling employed to detachably couple the barge units to each other and to the forward traction unit and rear caboose unit consists of a male coupling shaft extending from a universal joint mounted at the fore or aft of a barge unit and a female socket, for receiving the male coupling shaft, mounted at the aft or fore of a mating barge unit.

53 Claims, 5 Drawing Sheets

SEA GOING BARGE TRAIN

BACKGROUND OF THE INVENTION

1. Field of the Invention

The present invention generally relates to a sea-going barge train. More particularly, the present invention relates to a barge train or modular tanker vessel for ocean transportation of cargo, such as oil or other dry or liquid materials, consisting of a forward traction unit, a rear powered caboose unit and a series of modular units or barges interposed therebetween wherein the units are flexibly interconnected by means of a universal type coupling.

2. Description of the Prior Art

At present, over the sea transport of oil from production sites to refineries or remote storage facilities is accomplished by means of specialized ocean going vessels such as tankers and super-tankers. Such tankers are large vessels designed to transport up to 400,000 tons of oil. Because of the size of such vessels they can only pass through channels and be accepted in harbors which are large enough and deep enough to accommodate such large vessels. Furthermore, large tankers, such as super-tankers, are too large to pass through such artificial waterways as the Panama Canal or the Suez Canal to thus take advantage of the economies such artifical waterways were designed and built to provide. As a result, such super-tankers are required to traverse many additional thousands of miles of ocean in order to deliver their cargos.

The construction of a modern super-tanker requires a dry dock facility of huge proportions and other specialized facilities and relatively few shipyards in the world have the capability of undertaking such a project. Also, because of the large investment required to construct and operate such large vessels, ownership of super-tankers is generally restricted to very large and wealthy multinational corporations.

SUMMARY OF THE INVENTION

It is, therefore, a primary object of the present invention to provide a novel tanker vessel for sea transportation of cargos such as oil which is less expensive to construct and operate than heretofore, requires a much smaller dry dock facility for construction than is required for present day tankers of comparable capacity, can be accommodated in channels and harbors which are much smaller and shallower than those required to accommodate present day tankers of comparable capacity, and can pass through artificial waterways such as the Panama and Suez Canals.

The above object, as well as others which will hereinafter become apparent, is accomplished in accordance with the present invention by the provision of a modular tanker vessel consisting of a forward traction unit, a rear powered caboose unit and a series of modular units or barges interposed therebetween wherein the units are serially and flexibly interconnected by means of a universal type coupling which permits relative limited yaw, pitch and roll movement between units. The hull of each barge unit is substantially semi-cylindrically shaped so that the hull inmersed section is circular and the barge units are detachably coupled to each other fore and aft and to the traction and caboose units at the circle center of the circle segment defined by the hull cross section so that hull continuity of the barge train is maintained as the barge units roll relative to each other.

The universal type coupling employed to detachably couple the barge units to each other and to the forward traction unit and rear caboose unit consists of a male coupling shaft extending from a universal joint, such as a cardan or Hook joint or the ball of a ball and socket joint mounted at the fore (or aft) of a barge unit and a female socket, for receiving the male coupling shaft, mounted at the aft (or fore) of a mating barge unit. The universal joint of the male mating barge unit is mounted at the center of the circle defined by the hull cross section while the female socket of the female mating barge unit is also mounted, in its final locked position, at the center of the circle defined by the hull cross section. The female socket is carried by a housing adapted for vertical movement on the female mating barge unit so that the female socket can be vertically aligned with the male coupling shaft of the male mating barge during the coupling operation, where there is a difference in draft between the barges to be coupled. Furthermore, the female socket housing permits rotational movement of the female socket about vertical and horizontal axes during coupling of the mating barge units preceding the final locked position of the female socket to further promote the coupling operation. By repositioning the female socket housing so that the female socket is positioned at the center of the circle defined by the barge hull cross section and locking the female socket in its final locket position, following the coupling operation, the respective hulls of the mating barge units are aligned for hull continuity.

BRIEF DESCRIPTION OF THE DRAWINGS

Other objects and features of the present invention will become apparent from the following detailed description considered in connection with the accompanying drawings, in which.

DESCRIPTION OF THE PREFERRED EMBODIMENT

Figure 1:
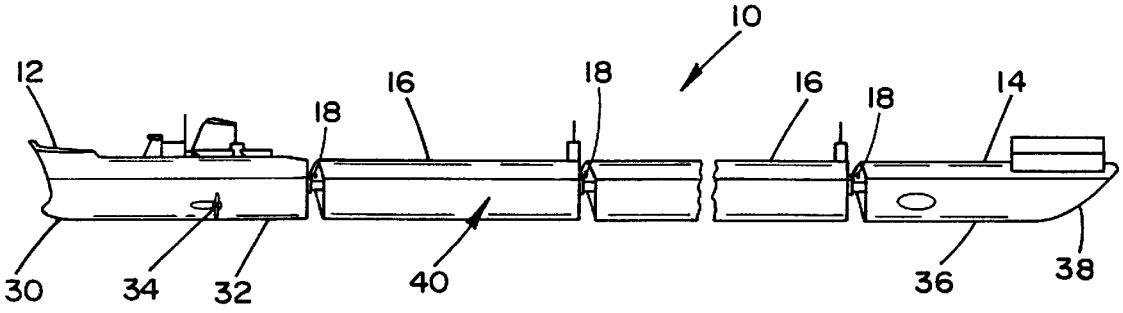
FIG. 1 is a broken side elevational view of a sea-going barge train according to the present invention.

Now turning to the drawings, there is shown in FIG. 1 a sea-going barge train according to the present invention, generally designated 10. Barge train 10, consists of a forward traction unit, designated 12, a rear powered caboose unit, designated 14, and a series of modular units or barges, designated 16. There can be a relatively large number of barge units 16 in each barge train 10 which are serially coupled together and to forward traction unit 12 and rear powered caboose 14 by means of universal type coupling 18. Universal type coupling 18, which will hereinbelow be described in detail, permits relative limited yaw, pitch and roll movement between the various units which thereby dramatically reduces dynamic torsional and bending stresses in the barge train hull due to wave action.

Figure 2:
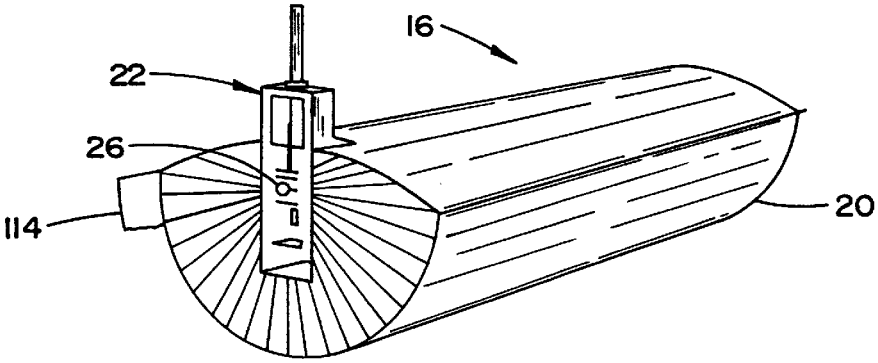
FIG. 2 is a perspective view of the female mating barge unit end according to the present invention.
Figure 3:
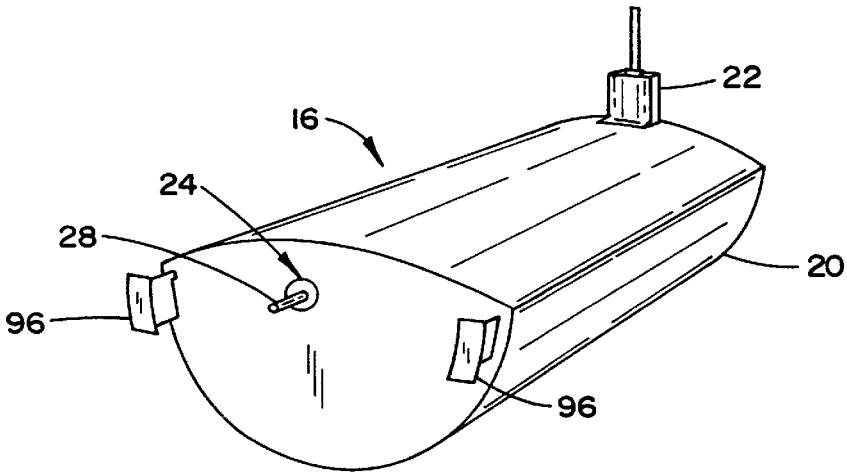
FIG. 3 is a perspective view of the male mating barge unit end according to the present invention.

Each barge unit 16 is designed to have a draft of about forty feet and a beam of one hundred feet thereby permitting the barge units to pass through the Panama Canal (which is one hundred ten feet wide) and to be acceptable in almost all harbors and channels. As clearly seen in FIGS. 2 and 3, barge unit 16 has a hull 20 of substantially semi-circular cross section, so that the hull immersed section is circular, which minimizes the ratio of the ratio of skin area to displacement thereby minimizing the frictional resistance of hull 20 as it passes through the water. FIG. 2 shows the end of barge unit 16 on which the female coupling mechanism, designated 22, of coupling 18 is mounted. FIG. 3 shows the end of barge unit 16 on which the male coupling mechanism, designated 24, of coupling 18 is mounted. As clearly seen, the female socket 26 of female coupling mechanism 22 and the male coupling shaft 28 of male coupling mechanism 24 are located at the circle center of the circle segment defined by the cross section of hull 20.

The forward traction unit 12 has a conventionally shaped bow 30 which merges at the mid and aft portions thereof to a hull 32 having the shape and dimensions of hull 20 of towed barge units 16. At the rear or aft portion of traction unit 12, the appropriate female or male coupling mechanism, 22 or 24, is provided for coupling the traction unit to the first of the serially coupled barge units 16. As with barge units 16, the location of the coupling mechanism, female or male as the case may be, is at the circle center of the circle segment defined by the cross section of hull 32. Traction unit 12 houses the propulsion machinery (not shown) for turning screw propellers 34 for propelling barge train 10.

The rear powered caboose unit 14 has a hull 36 with the same semi-circular cross sectional shape and dimension as hull 20 of barge unit 16 which merges into a streamlined shape at the end 38 of the unit. As in the case of forward traction unit 12, the front portion of caboose unit 14 is provided with the appropriate female or male coupling mechanism, 22 or 24, for coupling to the last of the serially coupled barge units 16. The location of this female or male coupling mechanism is also at the circle center of the circle segment defined by the cross section of hull 36. Caboose unit 14 houses propulsion machinery (not shown) and can be used to assist in braking barge train 10 when required. Powered caboose unit 14 can also be used as a tug for delivering individual barge units 16 into or out of harbors thereby obviating the necessity for the entire barge train 10 to enter into harbors which may be too small or shallow to accommodate large ships.

The hull under water transverse section, designated 40, of barge train 10 in FIG. 1, always remains circular as the individual units roll relative to each other so that hydraulic continuity of hull section 40 is maintained. This maintenance of the circular shape of hull under water transverse section 40 is a direct result of the shapes of hulls 20, 32, and 36 of the individual units of barge train 10, the universal type couplings 18 and the locations thereof.

Figure 4:
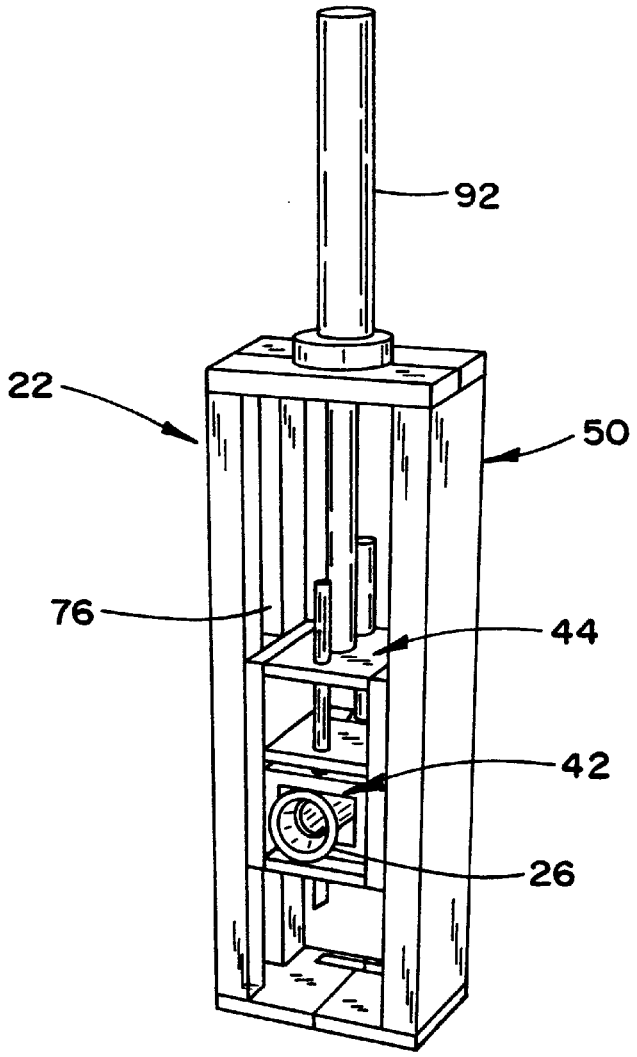
FIG. 4 is a perspective elevational view of the female coupling mechanism.
Figure 5:
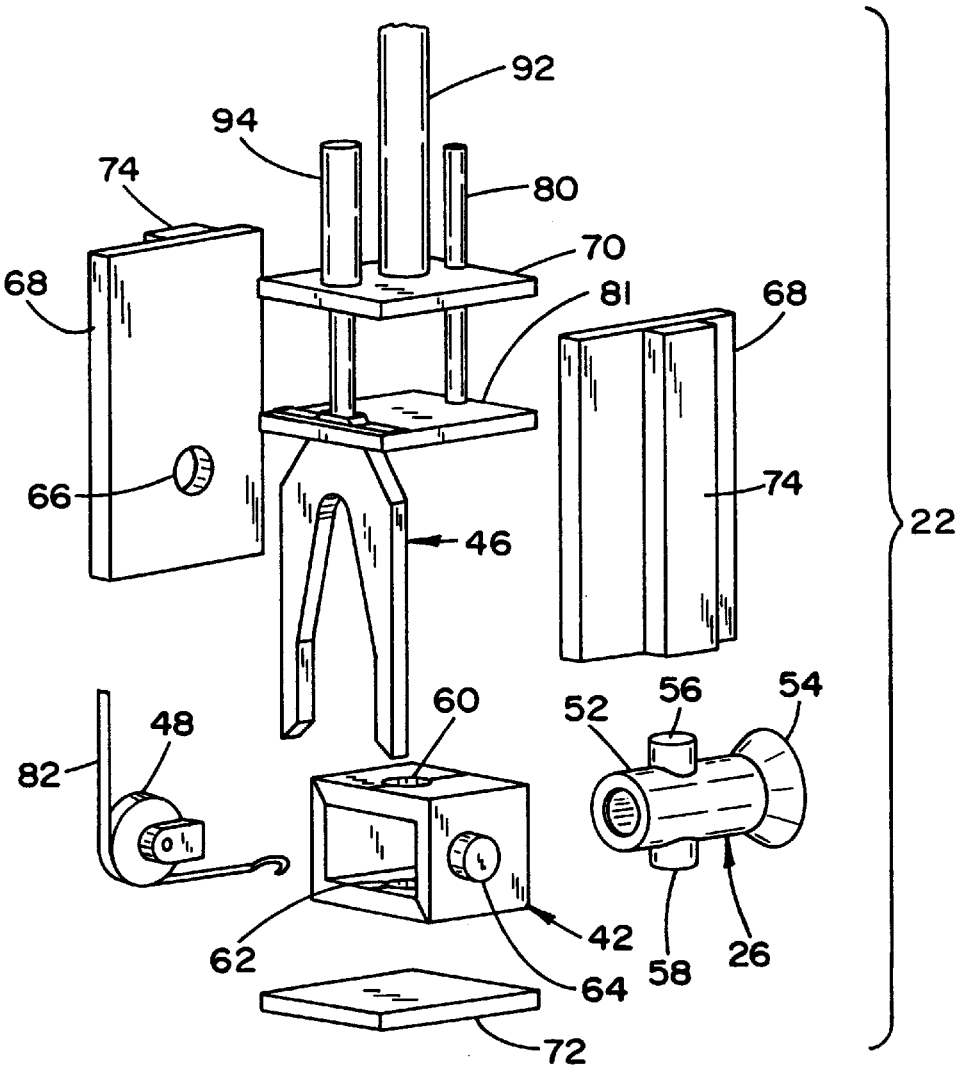
FIG. 5 is an exploded view of the female coupling mechanism of FIG. 4.

Universal type coupling 18, as indicated above, consists of a female coupling mechanism 22 mounted at the female mating end of a barge unit 16 and a male coupling mechanism 24 mounted at the male mating end of a barge unit 16. Complementary female and male coupling mechanisms, 22 and 24, are also mounted at the connecting ends of traction unit 12 and caboose unit 14. As clearly seen in FIGS. 4 and 5, female coupling mechanism 22 includes female socket 26, female socket housing 42, carriage housing 44, lock collar 46, pulley 48 and female socket vertical guide 50. Female socket 26 has a cylindrically shaped barrel portion 52 for receiving therein shaft 28 of male coupling mechanism 24 with a tapered funnel shaped forward portion 54 for facilitating coupling between female socket 26 and shaft 28. Vertically extending bearing shafts 56 and 58 extend from the top and bottom of barrel portion 52 and engage with top and bottom bearing sockets 60 and 62 in female socket housing 42 for securing female socket 26 therein and permitting pivotal movement of female socket 26 in the horizontal plane. Housing 42 is also provided with a pair of horizontally extending opposing bearing shafts, designated 64, which engage with bearing sockets 66 in the opposing sidewalls 68 of carriage housing 44 thereby permitting pivotal movement of housing 42 and female socket 26 in the vertical plane. This arrangement permits substantially universal type movement of female socket 26 in order to facilitate coupling with male coupling shaft 28, which will be explained more fully hereinafter. Carriage housing 44, which in addition to sidewalls 68 includes top, intermediate and bottom walls 70, 81 and 72, is provided with vertical guide rails 74 which are received in vertical tracks 76 of vertical guide 50. Vertical guide 50 is fixedly mounted to the female mating end of a barge unit 16, traction unit 12 or caboose unit 14. This structure permits vertical movement and positioning of female socket 26 in order to additionally facilitate the coupling procedure as more fully explained hereinafter. Guillotine type lock collar 46 is vertically movable and adapted to engage recess 78 of shaft 28 of male coupling mechanism 24 to prevent withdrawal of shaft 28 following the coupling operation. Engagement of lock collar 46 also restricts rotation in the horizontal plane and clockwise rotation in the vertical plane of female socket 26. Additional restriction of rotation of female socket 26 in the vertical plane is provided by vertically movable set screw 80 which is guided through aligned openings in top wall 70 and intermediate wall 81 of carriage housing 44 to move into engagement with the top of socket housing 92 following the coupling operation. Pulley 48 guides cable 82 which is threaded through barrel portion 52 of female socket 26 and is attached to the tip 84 of male coupling shaft 28 during the coupling operation. Cable 82 is operated by a winch (not shown) mounted on the deck of barge unit 16 and serves to guide shaft 28 into barrel portion 52 of female socket 26 and to pull barge 16 housing the male coupling mechanism 24 into coupling engagement with barge 16 housing the female coupling mechanism 22.

Figure 6:
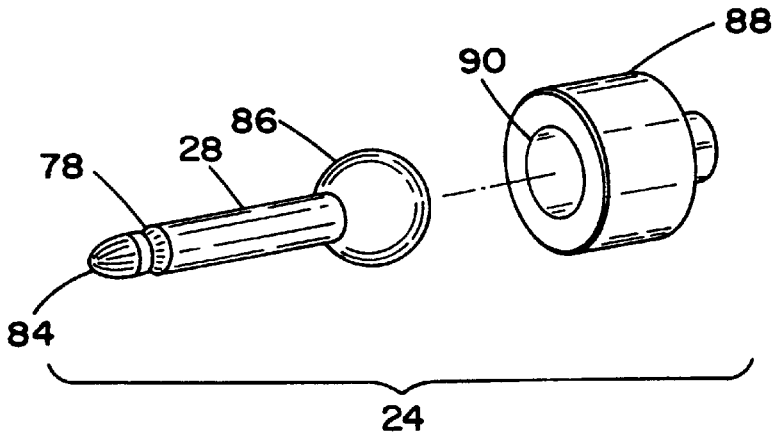
FIG. 6 is an exploded view of the male coupling mechanism.

Male coupling mechanism 24 includes a universal joint, such as a cardan or Hook universal joint or preferably a ball and socket joint as shown in FIG. 6. The male coupling mechanism 24 shown in FIG. 6 includes a ball 86 from which shaft 28 extends and socket 88 fixedly mounted to the male mating end of barge unit 16 at the circle center of the circle segment defined by the cross section of hull 20 of barge unit 16. Ball 86 is captured in socket 88 to form a ball and socket with shaft 28 extending through opening 90 at the forward end of socket 88.

Figure 7:
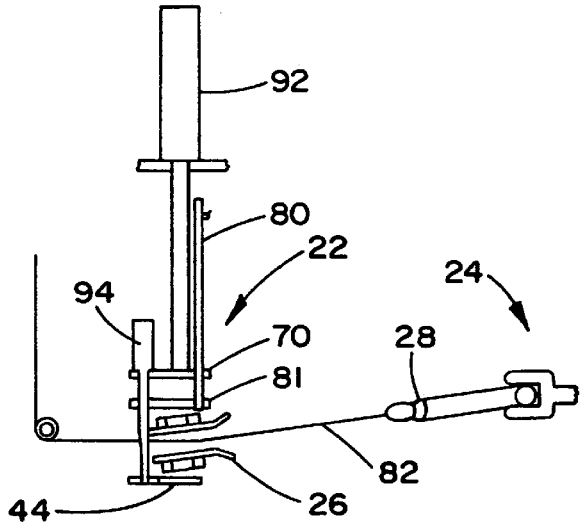
FIGS. 7 to 10 are schematic side elevational views of the male and female coupling mechanisms showing the sequence of the coupling operation.
Figure 8:
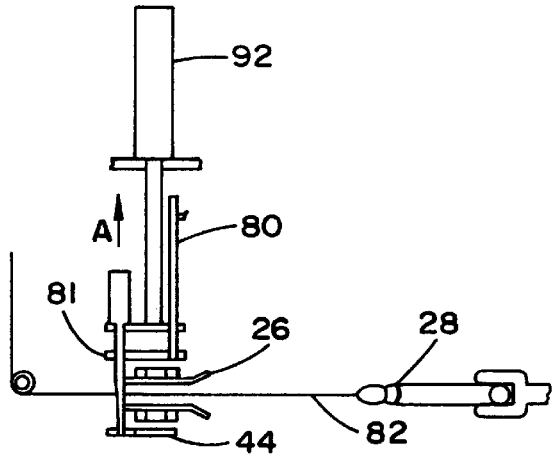
Figure 9:
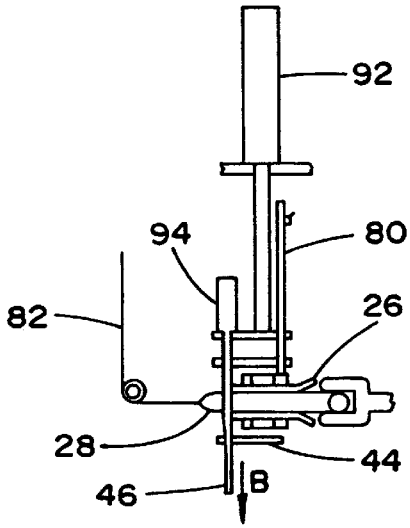
Figure 10:
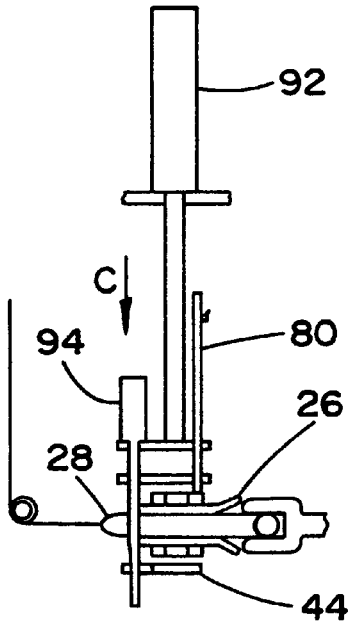

The coupling of female coupling mechanism 22 with male coupling mechanism 24 is shown in FIGS. 7 to 10 wherein initially female socket 26 is free to rotate in both the horizontal and vertical planes as shown in FIG. 7, in order to align the same with shaft 28 of male coupling mechanism 24. Cable 82 is then attached to male coupling shaft 28 and the vertical position of female socket 26 is adjusted in the direction of arrow "A" by mechanism 92, such as an adjustment screw or hydraulic ram, which causes carriage housing 44 to move verticaly in female socket vertical guide 50, so that the position of female socket 26 is substantially horizontally aligned with male coupling mechanism 24, as shown in FIG. 8. By thus horizontally aligning female socket 26 with male coupling mechanism 24, allowance is made for any difference in draft between the barge units being coupled. At this time the winch (not shown) associated with female coupling mechanism 22 is operated to take up cable 82 and and draw barge unit 16, on which male coupling mechanism 24 is mounted, towards barge unit 16 on which female coupling mechanism 22 is mounted, until male coupling shaft 28 enters into barrel portion 52 of female socket 26, as shown in FIG. 9. At this point the two barge units are substantially longitudinally aligned so that lock collar 46 may be lowered in the direction of arrow "B" by mechanism 94, such as an adjustment screw or hydraulic ram, to engage recess 78 of male coupling shaft 28 and lock the same to prevent withdrawal from female socket 26. Movable set screw 80 is then vertically adjusted to abut against the top of female socket housing 42 to prevent rotation thereof, as well as female socket 26, in the vertical plane. In the final stage of the coupling operation shown in FIG. 10, mechanism 92 is operated to adjust the vertical position of carriage housing 44 in the direction of arrow "C" to return female socket 26 to its final position at the circle center of the circle segment defined by the cross section of hull 20 of barge unit 16. Thus, the circle centers of the circle segments defined by the cross sections of the respective hulls 20 of the coupled barge units 16 are axially aligned. In the event the newly connected barge unit is empty it will ride high in the water and must be ballasted by a transfer of cargo, such as oil, from the other barge units of barge train 10 and/or water ballast in its ballast tanks, assuming the barge units have a double hull construction.

Figure 11:
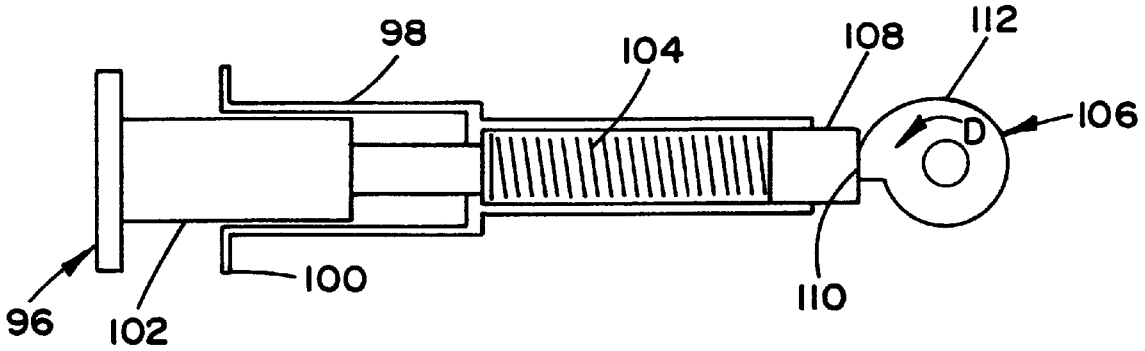
FIG. 11 is a cross-sectional side elevational view of the bumper employed between barge units.

As clearly seen in FIG. 3, a pair of bumpers 96 are provided at the lateral outer edges on one end, preferably the front end, of barge unit 16 and exert a predetermined pressure on the mated barge unit 16. The purpose of bumpers 96 is basically fourfold; first, to cushion impact during the coupling operation; two, to impart a limited lateral rigidity to barge train 10, giving the train a tendency to self align, particularly when at rest; three, to absorb shocks between adjacent barge units 16 in the event the turning radius of barge train 10 exceeds the lower design radius limit; and four, to provide yawing stability to the barge train 10 which is subject to longitudinal compression when in the trough of a wave. The bumper must also be retractable an amount sufficient to prevent interference during the coupling operation. A suitable bumper design is shown in FIG. 11 wherein the bumper housing 98 is mounted in the wall 100 of the end of barge unit 16 and is adapted to slidingly receive the shaft 102 of bumper 96. Bumper shaft 102 rests on spring 104 which provides sufficient bias to bumper 96 to accomplish the purposes set forth above. Of course, other biasing means may be used in place of spring 104, such as hydraulic means, etc. To permit retraction of bumper 96 during the coupling operation a cam 106 and cam follower 108 operate on spring 104. In normal operation, the high point or lobe 110 of cam 106 engages follower 108 to extend spring 104 and hence bumper 96 to its fully extended position. When it is desired to retract bumper 96, cam 106 is rotated in the direction of arrow "D" so that the low point 112 of cam 106 engages cam follower 108 permitting bumper 106 to be retracted the amount necessary to allow the coupling operation to be performed.

In the event the small gap between successive barge units 16 causes an unacceptable turbulent drag on barge train 10, the gap can be closed by means of a cowling 114, a broken away portion of which is shown in FIG. 2, or a flexible filler. The addition of cowling 114 serves to maintain hydraulic continuity between adjacent barge units 16 and between forward traction unit 12 and adjacent barge unit 16.

A feasibility study performed with respect to the barge train according to the present invention comparing it to a conventional tanker of 139,200 metric tons shows that the barge train will require 46% less hull steel than the conventional tanker. This demonstrates a very large savings in construction costs over the costs for a conventional tanker.

It is to be understood that the foregoing general and detailed descriptions are explanatory of the present invention and are not to be construed as restrictive of the scope of the following claims.

What is claimed is:

1. A modular tanker vessel adapted for the ocean transportation of cargo, said modular tanker vessel including:

a) a forward traction unit;

b) a rear caboose unit;

c) a plurality of barge units arranged serially between said forward traction unit and said rear caboose unit, each barge unit having a hull of substantially semi-cylindrical shape so that the hull immersed section is circular and a cross section of said hull defines a circle segment having a circle center lying on a longitudinal axis of the barge unit; and d) a universal coupling system detachably connecting each barge unit to adjacent barge units and connecting the forward traction unit to an adjacent barge unit and connecting the rear caboose unit to an adjacent barge unit at the circle centers of the circle segments defined by the cross sections of the barge unit hulls, said universal coupling system permitting relative limited yaw, pitch and roll movement between connected units, whereby the hull under water transverse section of the modular tanker vessel always remains circular as the connected units roll relative to each other so that hydraulic continuity is maintained.

2. The modular tanker vessel as defined in claim 1, wherein said forward traction unit has a bow merging at the mid and aft portions thereof to a hull whose shape corresponds to the shape of said hulls of said barge units.

3. The modular tanker vessel as defined in claim 2, wherein the universal coupling system connecting said forward traction unit to an adjacent barge unit is located at a circle center of a circle segment defined by a cross section of the semi-circular shape of the hull of said forward traction unit.

4. The modular tanker vessel as defined in claim 1, wherein said rear caboose unit has a hull whose shape corresponds to the shape of said hulls of said barge units which merges into a streamlined shape at an end of said rear caboose unit.

5. The modular tanker vessel as defined in claim 4, wherein the universal coupling system connecting said rear caboose unit to an adjacent barge unit is located at a circle center of a circle segment defined by a cross section of the semi-circular shape of the hull of said rear caboose unit.

6. The modular tanker vessel as defined in claim 1, wherein said universal coupling system includes a male coupling mechanism mounted on a male mating end of a barge, traction, caboose unit and an associated female coupling mechanism mounted on a female mating end of a barge, traction, caboose unit, said male coupling mechanism including a universal joint having a male coupling shaft extending therefrom, said female coupling mechanism including a female socket for receiving said male coupling shaft.

7. The modular tanker vessel as defined in claim 6, wherein said universal joint of said male coupling mechanism is a ball and socket joint.

8. The modular tanker vessel as defined in claim 6, which further includes means for locking in position said male coupling shaft so as to prevent withdrawal thereof from said female socket after coupling.

9. The modular tanker vessel as defined in claim 8, wherein the means for locking said male coupling shaft in position includes a vertically movable lock collar adapted to engage a recess in said male coupling shaft to prevent longitudinal movement thereof.

10. The modular tanker vessel as defined in claim 6, wherein said female coupling mechanism further includes means for horizontally aligning said female socket with said associated male coupling mechanism of the male mating end of a barge, traction, caboose unit during the coupling operation.

11. The modular tanker vessel as defined in claim 10, wherein the means for horizontally aligning said female socket with said associated male coupling mechanism includes vertical guide means for vertically guiding said female socket, and means for vertically moving and positioning said female socket in said vertical guide means so as to vertically position said female socket during the coupling operation in horizontal alignment with the associated male coupling mechanism.

12. The modular tanker vessel as defined in claim 6, wherein said female coupling mechanism further includes means for mounting said female socket so as to permit movement thereof so that said female socket can be aligned with the male coupling shaft of the associated male coupling mechanism during the coupling operation.

13. The modular tanker vessel as defined in claim 12, which further includes means for fixing the position of said female socket after coupling so that said female socket is substantially aligned with the longitudinal axis of the barge unit on which it is mounted.

14. The modular tanker vessel as defined in claim 12, wherein said means for mounting said female socket includes:

a) a female socket housing in which said female socket is mounted for pivotal movement in a defined plane; and b) a carriage housing in which said female socket housing is mounted for pivotal movement in a defined plane perpendicular to the defined plane of movement of said female socket.

15. The modular tanker vessel as defined in claim 6, which further includes a retractable cable extendable from said female socket of the female coupling mechanism and attachable to an end of said male coupling shaft of the associated male coupling mechanism so as to guide said male coupling shaft into said female socket during the coupling operation.

16. The modular tanker vessel as defined in claim 1, which further includes a cowling extending between adjacent barge units, the forward traction unit and an adjacent barge unit, and the rear caboose unit and an adjacent barge unit so as to close a gap therebetween and maintain hydraulic continuity between adjacent units.

17. The modular tanker vessel as defined in claim 1, which further includes a pair of bumpers provided at lateral outer edges on an end of each barge unit extending towards an adjacent unit for exerting a predetermined biasing pressure on the adjacent unit.

18. The modular tanker vessel as defined in claim 17, wherein said bumpers are retractable to an extent sufficient to prevent interference during coupling of adjacent barge units.

19. The modular tanker vessel as defined in claim 9, wherein said female coupling mechanism further includes:

a) a female socket housing in which said female socket is mounted for pivotal movement in a defined plane;

b) a carriage housing in which said female socket housing is mounted for pivotal movement in a defined plane perpendicular to the defined plane of movement of said female socket;

c) a female socket vertical guide mounted on the female mating end of a barge, traction, caboose unit;

d) guide means associated with said female socket vertical guide and said carriage housing for vertically guiding said carriage housing along said female socket vertical guide;

e) means for vertically moving and positioning said carriage housing along said female socket vertical guide so as to vertically position said female socket during the coupling operation in horizontal alignment with the associated male coupling mechanism mounted on the male mating end of a barge, traction, caboose unit; and f) means for fixing the position of said female socket after coupling so that said female socket is substantially aligned with the longitudinal axis of the barge unit on which it is mounted.

20. A barge unit for use in a modular tanker vessel adapted for the ocean transportation of cargo, said barge unit having a hull of semi-cylindrical shape so that the hull immersed section is circular and a cross section of said hull defines a circle segment having a circle center lying on a longitudinal axis of the barge unit, said barge unit further including a male coupling mechanism at a first male mating end of said barge unit located at the circle center of the circle segment defined by the cross section of the barge unit hull, and a female coupling mechanism at a second female mating end of said barge unit located at the circle center of the circle segment defined by the cross section of the barge unit hull.

21. The barge unit as defined in claim 20, wherein said male coupling mechanism includes a universal joint mounted on the male mating end of the barge unit having a male coupling shaft extending from said universal joint, and said female coupling mechanism includes a female socket for receiving a male coupling shaft of an associated male coupling mechanism of another barge unit.

22. The barge unit as defined in claim 21, wherein said universal joint of said male coupling mechanism is a ball and socket joint.

23. The barge unit as defined in claim 21, which further includes means associated with said female coupling mechanism for locking in position the male coupling shaft received in said female socket to prevent withdrawal thereof after coupling.

24. The barge unit as defined in claim 23, wherein the means for locking said male coupling shaft in position includes a vertically movable lock collar adapted to engage a recess in said male coupling shaft to prevent longitudinal movement thereof.

25. The barge unit as defined in claim 21, wherein said female coupling mechanism further includes vertical guide means for vertically guiding said female socket, and means for vertically moving and positioning said female socket in said vertical guide means so as to vertically position said female socket during the coupling operation in horizontal alignment with the associated male coupling mechanism.

26. The barge unit as defined in claim 21, wherein said female coupling mechanism further includes means for mounting said female socket so as to permit movement thereof so that said female socket can be aligned with the male coupling shaft of the associated male coupling mechanism during the coupling operation.

27. The barge unit as defined in claim 26, which further includes means for fixing the position of said female socket after coupling so that said female socket is substantially aligned with the longitudinal axis of the barge unit on which it is mounted.

28. The barge unit as defined in claim 26, wherein said means for mounting said female socket includes:

a) a female socket housing in which said female socket is mounted for pivotal movement in a defined plane; and b) a carriage housing in which said female socket housing is mounted for pivotal movement in a defined plane perpendicular to the defined plane of movement of said female socket.

29. The barge unit as defined in claim 21, which further includes a retractable cable extendable from said female socket of the female coupling mechanism and attachable to an end of said male coupling shaft of the associated male coupling mechanism of another barge unit so as to guide said male coupling shaft into said female socket during the coupling operation.

30. The barge unit as defined in claim 20, which further includes a cowling extending from an end of said barge unit so as to close a gap between said barge unit and an adjacent barge unit.

31. The barge unit as defined in claim 20, which further includes a pair of bumpers provided at lateral outer edges on an end of said barge unit extending towards an adjacent barge unit for exerting a predetermined biasing pressure on said adjacent barge unit.

32. The barge unit as defined in claim 31, wherein said bumpers are retractable to an extent sufficient to prevent interference during coupling of said adjacent barge unit.

33. The barge unit as defined in claim 24, wherein said female coupling mechanism further includes:

a) a female socket housing in which said female socket is mounted for pivotal movement in a defined plane;

b) a carriage housing in which said female socket housing is mounted for pivotal movement in a defined plane perpendicular to the defined plane of movement of said female socket;

c) a female socket vertical guide mounted on the female mating end of said barge unit;

d) guide means associated with said female socket vertical guide and said carriage housing for vertically guiding said carriage housing along said female socket vertical guide;

e) means for vertically moving and positioning said carriage housing along said female socket vertical guide so as to vertically position said female socket during the coupling operation in horizontal alignment with the associated male coupling mechanism mounted on another barge unit; and f) means for fixing the position of said female socket after coupling so that said female socket is substantially aligned with the longitudinal axis of the barge unit on which it is mounted.

34. A universal coupling system for detachably coupling together units of a modular tanker vessel adapted for the ocean transportation of cargo, said modular tanker vessel including a forward traction unit, a rear caboose unit, and a plurality of barge units wherein said units have hulls of substantially semicylindrical shape so that the hull immersed section is circular and a cross section of said hull defines a circle segment having a circle center lying on a longitudinal axis of the unit, said universal coupling system including a male coupling mechanism adapted to be mounted on a male mating end of a barge, traction, caboose unit, said male coupling mechanism including a universal joint having a male coupling shaft extending therefrom, said female coupling mechanism including a female socket adapted to receive said male coupling shaft, wherein said female coupling mechanism further includes means for mounting said female socket so as to permit movement thereof so that said female socket can be aligned with the male coupling shaft of the associated male coupling mechanism during the coupling operation.

35. The universal coupling system as defined in claim 34, wherein said universal joint of said male coupling mechanism is a ball and socket joint.

36. The universal coupling system as defined in claim 34, which further includes means for locking in position said male coupling shaft so as to prevent withdrawal thereof from said female socket after coupling.

37. The universal coupling system as defined in claim 36, wherein the means for locking said male coupling shaft in position includes a vertically movable lock collar adapted to engage a recess in said male coupling shaft to prevent longitudinal movement thereof.

38. The universal coupling system as defined in claim 34, wherein said female coupling mechanism further includes means for horizontally aligning said female socket with said associated male coupling mechanism of the male mating end of a barge, traction, caboose unit during the coupling operation.

39. The universal coupling system as defined in claim 38, wherein the means for horizontally aligning said female socket with said associated male coupling mechanism includes vertical guide means for vertically guiding said female socket, and means for vertically moving and positioning said female socket in said vertical guide means so as to vertically position said female socket during the coupling operation in horizontal alignment with the associated male coupling mechanism.

40. The universal coupling system as defined in claim 34, which further includes means for fixing the position of said female socket after coupling so that said female socket is substantially aligned with the longitudinal axis of the barge unit on which it is mounted.

41. The universal coupling system as defined in claim 34, wherein said means for mounting said female socket includes:

a) a female socket housing in which said female socket is mounted for pivotal movement in a defined plane; and b) a carriage housing in which said female socket housing is mounted for pivotal movement in a defined plane perpendicular to the defined plane of movement of said female socket.

42. The universal coupling system as defined in claim 34, which further includes a retractable cable extendable from said female socket of the female coupling mechanism and attachable to an end of said male coupling shaft of the associated male coupling mechanism so as to guide said male coupling shaft into said female socket during the coupling operation.

43. The universal coupling system as defined in claim 37, wherein said female coupling mechanism further includes:

a) a female socket housing in which said female socket is mounted for pivotal movement in a defined plane;

b) a carriage housing in which said female socket housing is mounted for pivotal movement in a defined plane perpendicular to the defined plane of movement of said female socket;

c) a female socket vertical guide mounted on the female mating end of a barge, traction, caboose unit;

d) guide means associated with said female socket vertical guide and said carriage housing for vertically guiding said carriage housing along said female socket vertical guide;

e) means for vertically moving and positioning said carriage housing along said female socket vertical guide so as to vertically position said female socket during the coupling operation in horizontal alignment with the associated male coupling mechanism mounted on the male mating end of a barge, traction, caboose unit; and f) means for fixing the position of said female socket after coupling so that said female socket is substantially aligned with the longitudinal axis of the barge unit on which it is mounted.

44. A universal coupling system for detachably coupling together units of a modular tanker vessel adapted for the ocean transportation of cargo, said modular tanker vessel including a forward traction unit, a rear caboose unit, and a plurality of barge units, said universal coupling system including a male coupling mechanism adapted to be mounted on a female mating end of a barge, traction, caboose unit and associated female coupling mechanism adapted to be mounted on a male mating end of a barge, traction, caboose unit, said male coupling mechanism including a universal joint having a male coupling shaft extending therefrom, said female coupling mechanism including a female socket adapted to receive said male coupling shaft, wherein said female coupling mechanism further includes means for mounting said female socket so as to permit movement thereof so that said female socket can be aligned with the male coupling shaft of the associated male coupling mechanism during the coupling operation.

45. The universal coupling system as defined in claim 44, wherein said universal joint of said male coupling mechanism is a ball and socket joint.

46. The universal coupling system as defined in claim 44, which further includes means for locking in position said male coupling shaft so as to prevent withdrawal thereof from said female socket after coupling.

47. The universal coupling system as defined in claim 46, wherein the means for locking said male coupling shaft in position includes a vertically movable lock collar adapted to engage a recess in said male coupling shaft to prevent longitudinal movement thereof.

48. The universal coupling system as defined in claim 44, wherein said female coupling mechanism further includes means for horizontally aligning said female socket with said associated male coupling mechanism of the male mating end of a barge, traction, caboose unit during the coupling operation.

49. The universal coupling as defined in claim 48, wherein the means for horizontally aligning said female socket with said associated male coupling mechanism includes vertical guide means for vertically guiding said female socket, and means for vertically moving and positioning said female socket in said vertical guide means so as to vertically position said female socket during the coupling operation in horizontal alignment with the associated male coupling mechanism.

50. The universal coupling system as defined in claim 44, which further includes means for fixing the position of said female socket after coupling so that said female socket is substantially aligned with the longitudinal axis of the barge unit on which it is mounted.

51. The universal coupling system as defined in claim 44, wherein said means for mounting said female socket includes:

a) a female socket housing in which said female socket is mounted for pivotal movement in a defined plane; and b) a carriage housing in which said female socket housing is mounted for pivotal movement in a defined plane perpendicular to the defined plane of movement of said female socket.

52. The universal coupling system as defined in claim 44, which further includes a retractable cable extendable from said female socket of the female coupling mechanism and attachable to an end of said male coupling shaft of the associated male coupling mechanism so as to guide said male coupling shaft into said female socket during the coupling operation.

53. The universal coupling system as defined in claim 47, wherein said female coupling mechanism further includes:

a) a female socket housing in which said female socket is mounted for pivotal movement in a defined plane;

b) a carriage housing in which said female socket housing is mounted for pivotal movement in a defined plane perpendicular to the defined plane of movement of said female socket;

c) a female socket vertical guide mounted on the female mating end of a barge, traction, caboose unit;

d) guide means associated with said female socket vertical guide and said carriage housing for vertically guiding said carriage housing along said female socket vertical guide;

e) means for vertically moving and positioning said carriage housing along said female socket vertical guide so as to vertically position said female socket during the coupling operation in horizontal alignment with the associated male coupling mechanism mounted on the male mating end of a barge, traction, caboose unit; and f) means for fixing the position of said female socket after coupling so that said female socket is substantially aligned with the longitudinal axis of the barge unit on which it is mounted.

* * * * *